US006561256B2

(12) United States Patent
Mullet

(10) Patent No.: US 6,561,256 B2
(45) Date of Patent: May 13, 2003

(54) EXTENSION SPRING COUNTERBALANCE SYSTEM

(75) Inventor: Willis J. Mullet, Gulf Breeze, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/842,301

(22) Filed: Apr. 25, 2001

(65) Prior Publication Data

US 2002/0157797 A1 Oct. 31, 2002

(51) Int. Cl.[7] ..... E05F 11/54
(52) U.S. Cl. ..... 160/191; 160/201; 49/200
(58) Field of Search ..... 160/201, 191, 160/192, 193, 188; 49/200; 16/197, 198

(56) References Cited

U.S. PATENT DOCUMENTS

| | | | | |
|---|---|---|---|---|
| 2,023,909 A | * | 12/1935 | Wread | |
| 2,099,191 A | * | 11/1937 | Blodgett | |
| 2,335,336 A | | 11/1943 | Zoller | 268/59 |
| 3,095,922 A | * | 7/1963 | Frazier | |
| 3,160,200 A | * | 12/1964 | McKee et al. | |
| 3,165,143 A | * | 1/1965 | Jackwig | |
| 5,103,890 A | * | 4/1992 | Cloutier | |
| 5,259,433 A | * | 11/1993 | Cloutier | |
| 5,577,544 A | | 11/1996 | Carper et al. | 160/191 |
| 5,615,723 A | | 4/1997 | Carper | 160/191 |
| 5,803,149 A | * | 9/1998 | Halley et al. | |
| 5,930,865 A | * | 8/1999 | Mihalcheon | |
| 6,082,430 A | | 7/2000 | Mock | 160/201 |

FOREIGN PATENT DOCUMENTS

| | | | |
|---|---|---|---|
| CA | 917504 | * 12/1972 | |
| EP | 0 651 123 | 2/1994 | E05F/15/16 |

* cited by examiner

*Primary Examiner*—Blair M. Johnson
(74) *Attorney, Agent, or Firm*—Renner, Kenner, Greive, Bobak, Taylor & Weber

(57) ABSTRACT

An upwardly acting sectional door system including, a door (D) having a plurality of hinged door sections (16–18) movable between a closed vertical position and an open horizontal position, a drive tube (31) mounted above the door in the closed vertical position, an operator (11) selectively directionally rotatably driving the drive tube, cable drums (35) mounted on the drive tube for rotation therewith by the operator, springs (60) mounted in operative relation to the cable drums, and counterbalance cables (75) reeved about the cable drums and interconnecting the springs and the door to counterbalance the door when moving between the closed vertical position and the open horizontal position.

25 Claims, 4 Drawing Sheets

EXTENSION SPRING COUNTERBALANCE SYSTEM

TECHNICAL FIELD

The present invention relates generally to counterbalance systems for upwardly acting sectional doors. More particularly, the present invention relates to such a counterbalance system having cable storage drums which match the force of the counterbalance system with the gravitational force on the door during payout and retrieval of the cable interconnecting the door with the counterbalance system during movement of the door between a closed vertical position and an open horizontal position. More specifically, the present invention relates to operator-driven cable storage drums having differing diameter grooves about which a counterbalance cable is looped and attached to the door to one side of the drum and to an extension spring on the other side of the drum, whereby the linear force of the extension spring is matched to the nonlinear gravitational force exerted on a sectional door as it is moved between the closed vertical position and the open horizontal position.

BACKGROUND ART

Counterbalance systems for sectional doors have been employed for many years. Common examples of sectional doors are the type employed as garage doors in homes, commercial and utility building doors, and similar applications. Counterbalance systems originally solved the need for providing mechanical assistance in the instance of very large doors for commercial installations and garage doors for residential use, which were constructed of a relatively thick wood or metal components. More recently, counterbalance systems have been increasingly used to permit opening and closing operations by a single person and to facilitate the use of electric motors, preferably of limited size, to power the opening and closing of such doors.

Most such counterbalance systems utilize drums which carry cables attached to the garage door. Commonly, the drums are mounted above the frame defining the door opening with a drum positioned at each end of the door such that the cables may be conveniently connected proximate the lower lateral corners of the garage door. Basically, the door is moved toward the closed position blocking the door opening due to gravity acting on the door as it moves from a substantially horizontal open position above and inwardly of the door frame to a closed vertical position. The path of the door in opening and closing is commonly defined by a track arrangement which interacts with the rollers attached to the various sections of the door. The cable drums are classically interconnected with springs in a wide variety of ways so that they are progressively loaded as the door is lowered to prevent uncontrolled descent of the door and employ stored energy in the springs to assist in raising the door during the subsequent opening operation.

One type of counterbalance system which has been in use in the industry for many years employs extension springs. These extension springs are classically mounted adjacent the horizontal tracks or rails which support a door in the open position. The extension spring expands longitudinally as force is applied from a cable attached to a sheave at one end of the extension spring and proceeds to a single sheave positioned proximate the frame of the door which redirects the counterbalance cable to the bottom panel of the door. The force exerted by an extension spring upon elongation is essentially linear, whereas force exerted on a sectional door as it is moved upwardly and downwardly is a nonlinear gravitational force. With no possibility of adjustment during operation, the tension in conventional extension spring systems is optimal only at a small portion of its operating range with a compromise implemented between clearing the door out of the door opening when it is in the open position and maintaining it seated on the floor when the door is in the closed position. The result is that the available spring tension at neither the fully closed position nor the fully opened position can be optimized.

In the case of torsion springs operating on shafts mounted above the door in the closed position, the utilization of drums on such a shaft with a uniform diameter of the cable drum or grooves formed in the cable drum with a uniform diameter creates a condition where force applied by the torsion springs through the shaft and drums is essentially linear, whereas the gravitational force exerted on a moving sectional door is nonlinear. Therefore, as in the case of conventional extension spring systems, an undesirable compromise must be struck to effect satisfactory positioning of the door via spring tensioning in the fully opened and fully closed positions.

In an effort to obviate adjustment problems encountered in such conventional doors, spiral cable storage drums have been developed in recent years which have the first two or three outboard grooves on the cable drums designed with larger but decreasing minor diameters than the grooves extending inboard for the remainder of the drum surface. This allows the last coils of the counterbalance cable being removed from the drum during door closure to exert a greater force from the weight of the door against the tension on the counterbalance springs. In turn, this allows the counterbalance springs to be adjusted with extra tension to help displace the door from the door opening when the door is in the open position. However, the raised grooves engaged when the door approaches the closed position reduce the tension effects of the spring thereby allowing the door to seat and remain seated on the floor without uncontrolled lifting of the door.

Storage drums employing these grooves at one extent thereof require a maximum spring tension to achieve the multiple open and closed operating conditions discussed above. As a result, the normal operation of a sectional door through the majority of the operating range between positions proximate the opened and closed locations may result in the door being difficult to move or moving uncontrollably at certain locations. Thus, the adjustment of known sectional garage door counterbalance systems has remained a compromise of essentially conflicting considerations.

DISCLOSURE OF THE INVENTION

Therefore, an object of the present invention is to provide a counterbalance system employing extension springs which uses cable drums attached to a drive tube to replace the conventional front mounted pulleys for interconnecting the extension spring with the door. Another object of the present invention is to provide such a counterbalance system which adds control or regulation to door movement in allowing the energy from the two extension springs to be equally distributed to the door. A further object of the invention is to provide such a counterbalance system which allows the attachment of a jack shaft or header mounted operator to power the drive tube carrying the cable drums. Yet another object of the present invention is to provide such a counterbalance system wherein force distribution from the extension springs to the door through drums rotationally connected by the drive tube may prevent racking or canting of the door to a misaligned position in the event of the failure of the springs or cable of the counterbalance system.

Another object of the present invention is to provide a counterbalance system for sectional doors wherein the linear force of the springs is matched to the nonlinear gravitational force exerted on a sectional door as it is moved between the closed vertical position and the open horizontal position. A further object of the present invention is to provide such a counterbalance system wherein the pitch diameter of the grooves in the drums are varied over its length in a manner designed to optimize performance of the door during its final movement to the closed position, its final movement to the open position, and intermediate or transition positions therebetween. Still another object of the present invention is to provide such a counterbalance system having drum grooves configured to negate force from the remaining weight of the door against the counterbalance system as the door approaches the open position, to maximize the weight of the door as it approaches the closed position to assume and retain a seated closure, and to progressively balance the weight of the door against the counterbalance system.

Still another object of the present invention is to provide a counterbalance system for sectional doors wherein an operator-powered tube carrying cable drums has the cables interconnecting the springs with the door looped or reeved about the drums one or more times but not stored on the drums. A still further object of the present invention is to provide such a counterbalance system wherein the tension on the cables is adjusted such that the cable loop or loops on the drum do not slip in relationship to the drums during the full operating sequence of the door. Still another object of the present invention is to provide such a counterbalance system wherein spring tension operative on the door through the drum may be increased to prevent slippage of the cable loop or loops about the drum without affecting the counterbalancing of the door while concomitantly enhancing the ability of the increased spring tension to move the door out of the door opening in the fully open position of the door.

Still a further object of the present invention is to provide a counterbalance system having two mounted drums interposed between the counterbalance springs and the door, wherein the drums have grooves having differing minor diameters at different locations along the axial length of the drums. A further object of the present invention is to provide such a counterbalance system in which three separate arrays of grooves along the axial length of the drums provide optimized control of the door when moving between the closed vertical position and the open horizontal position. A still further object of the present invention is to provide such a counterbalance system which has improved operation at minimal additional cost, which is compatible with current industry safety standards, which can be designed for implementation with a variety of doors of differing sizes and weights, and which can be readily retrofit on existing doors having conventional extension spring counterbalance systems.

In general, the present invention contemplates an upwardly acting sectional door system having, a door having a plurality of hinged door sections movable between a closed vertical position and an open horizontal position, a drive tube mounted above the door in the closed vertical position, an operator selectively directionally rotatably driving the drive tube, cable drums mounted on the drive tube for rotation therewith by the operator, springs mounted in operative relation to the cable drums, and counterbalance cables reeved about the cable drums and interconnecting the springs and the door to counterbalance the door when moving between the closed vertical position and the open horizontal position.

PREFERRED EMBODIMENT FOR CARRYING OUT THE INVENTION

Figure 1:
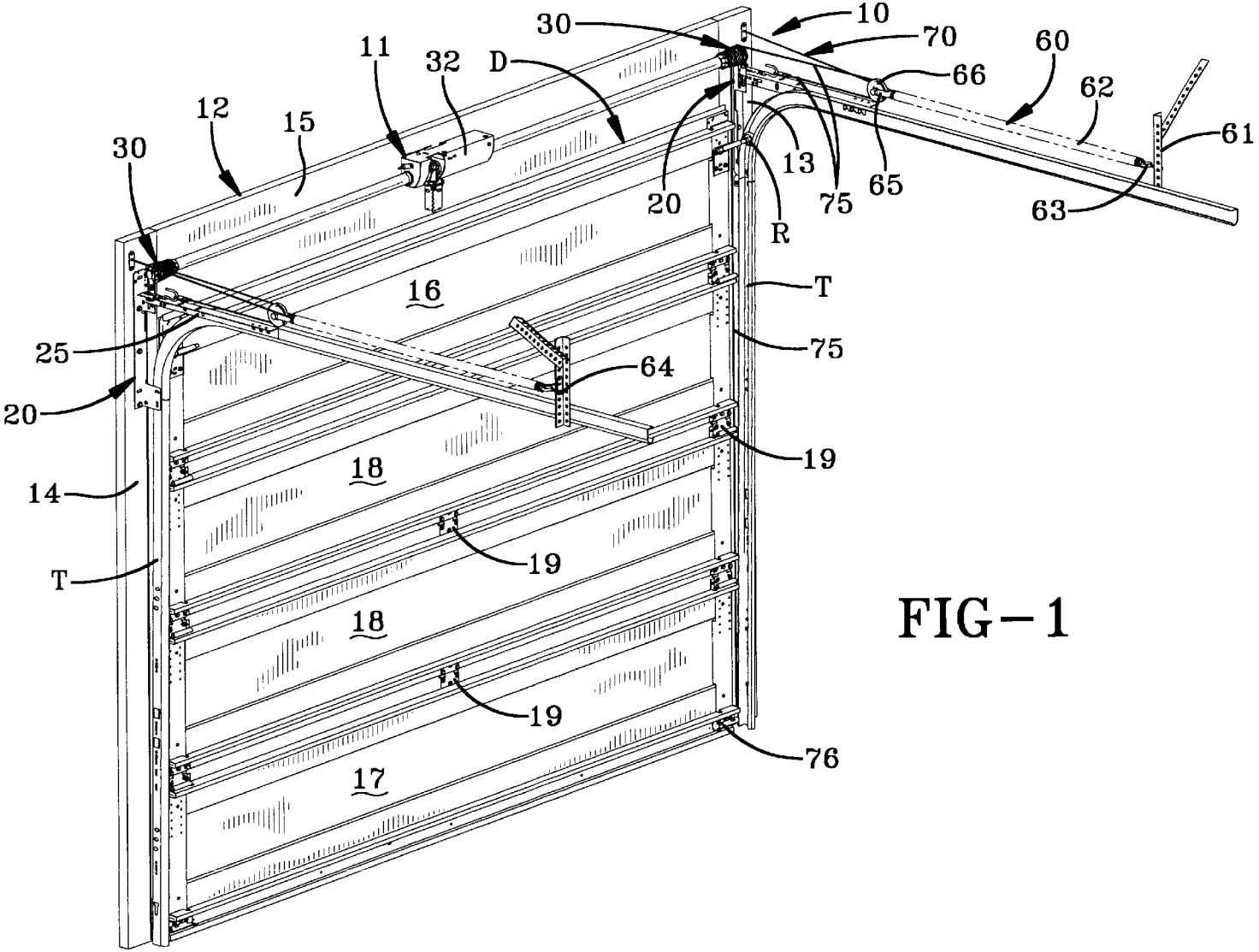
FIG. 1 is an interior perspective view of a sectional door with a counterbalance system according to the concepts of the present invention having cable drums operative with extension springs to control movement of the door between the closed vertical position and the open horizontal position.
Figure 2:
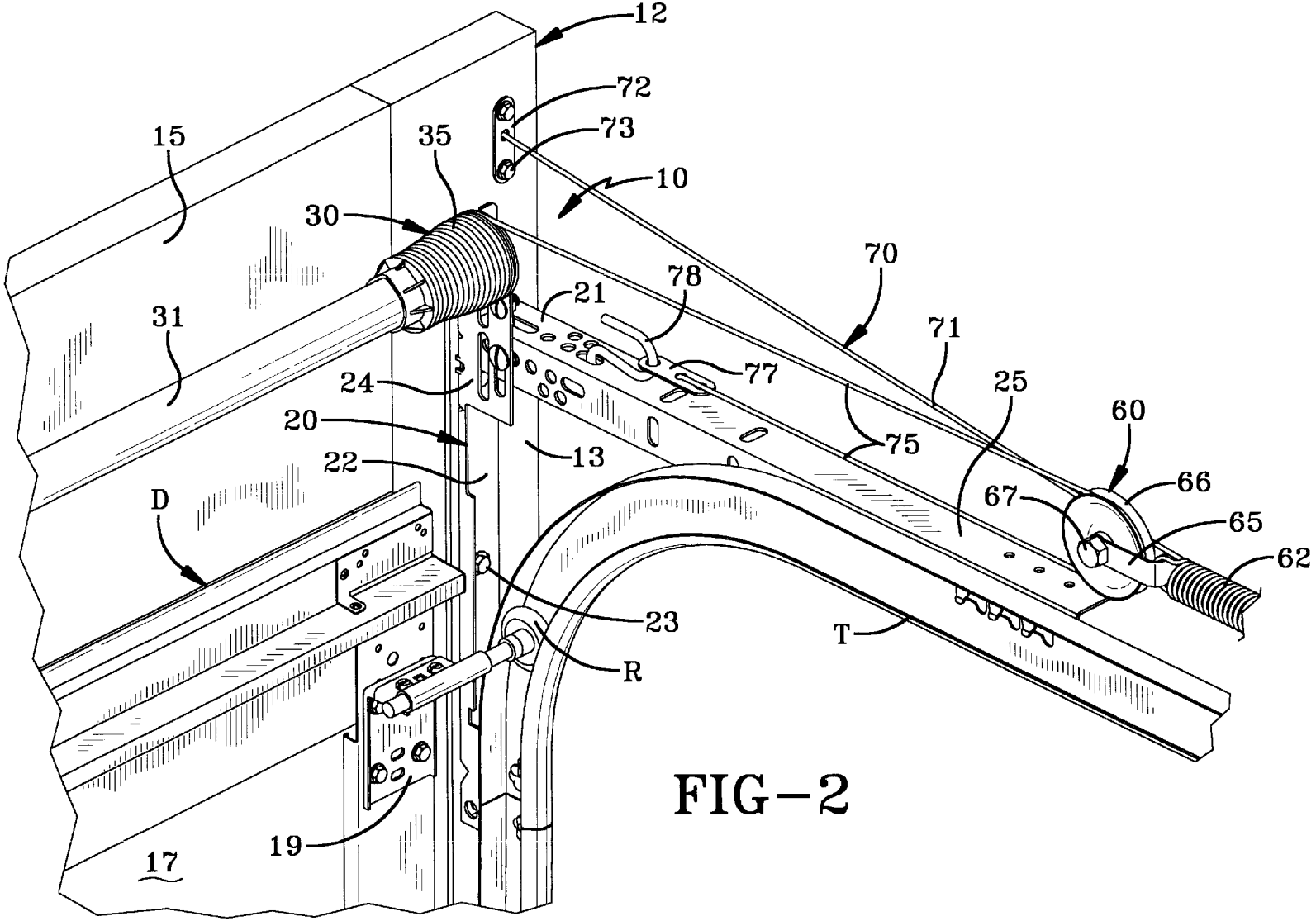
FIG. 2 is an enlarged fragmentary perspective depicting the cable drum to the right side of a door as seen in FIG. 1 showing details of the interrelation of the cable, extension spring, and cable drum mechanism.

A counterbalance system according to the concepts of the present invention is generally indicated by the numeral 10 in FIGS. 1 and 2 of the drawings. The counterbalance system 10 is shown mounted in conjunction with a sectional door, generally indicated by the letter D, and may include an operator system, generally indicated by the numeral 11, which may be a type of jack shaft operator and may be employed particularly in garages for residential housing. The opening in which the door D is positioned for moving between a closed vertical position and an open horizontal position is defined by a frame, generally indicated by the numeral 12. The frame 12 consists of a pair of spaced jambs 13 and 14 that, as seen in FIG. 1, are generally parallel and extend vertically upwardly from the ground or a floor (not shown). The jambs 13, 14 are spaced and joined at their vertical upward extremity by a header 15 to thereby delineate a generally inverted U-shaped frame 12 around the opening for the door D. The frame 12 is normally constructed of wood for purposes of reinforcement and facilitating the attachment of elements for supporting and controlling the door D, including the operator system 11. The door D has a top section 16, a bottom section 17, and one or more intermediate sections 18 which are interconnected by horizontally spaced hinges 19 in a manner well known to persons skilled in the art.

Affixed to the jambs 13, 14 proximate the upper extremities thereof and the lateral extremities of the header 15 to either side of the door D are flag angles, generally indicated by the numeral 20. The flag angles 20 generally consist of L-shaped vertical members 21 having a leg 22 attached to an underlying jamb 13, 14 by lag bolts 23, or the like, and a projecting leg 24 preferably disposed substantially perpendicular to the leg 22 and, therefore, perpendicular to the jambs 13, 14. Associated with flag angles 20 is a horizontal angle iron 25 extending from the projecting leg 24 and supporting roller tracks T, T located to either side of door D. Tracks T, T provide a guide system for rollers R attached to either side of the door D, in a manner well known to persons skilled in the art. The horizontal angle irons 25 normally extend substantially perpendicular to the jambs 13, 14 and may be attached to the transition portion of tracks T, T between the vertical section and the horizontal section thereof or at the beginning of the horizontal section of tracks T, T closest to the jambs 13, 14. The tracks T, T define the travel of the door D in moving between the closed vertical position and the open horizontal position of the door D.

The operator system 11 interrelates with the door D through counterbalance system 10 including cable drum mechanisms, generally indicated by the numeral 30. As shown, the cable drum mechanisms 30 are positioned on a drive tube 31 which extends a substantial portion of the distance between the flag angles 20, 20 to either side of the door D. If desired, the drive tube 31 could be constructed of two or more telescoping members to facilitate packaging, assembly, and/or adjustment. As shown, the cable drum mechanisms 30 are positioned on the drive tube 31 at the ends thereof and are in all instances nonrotatably affixed to the drive tube 31. As seen in FIG. 1, the operator system 11 may have an operator housing 32 which encloses a length of drive tube 31 that interacts with the operator drive elements (not shown) in a manner known to persons skilled in the art to selectively effect rotational drive of the drive tube 31 in both rotational directions to supply the power required for driving the door D between the closed vertical position and the open horizontal position. While drive tube 31 is depicted as a hollow tubular member that is noncircular in cross-section (see FIGS. 3 and 4), it is to be appreciated that circular drive tubes, solid shafts and other types of driving elements capable of rotating the cable drum mechanisms 30 may be employed and are encompassed within this terminology in the context of this specification.

Figure 4:
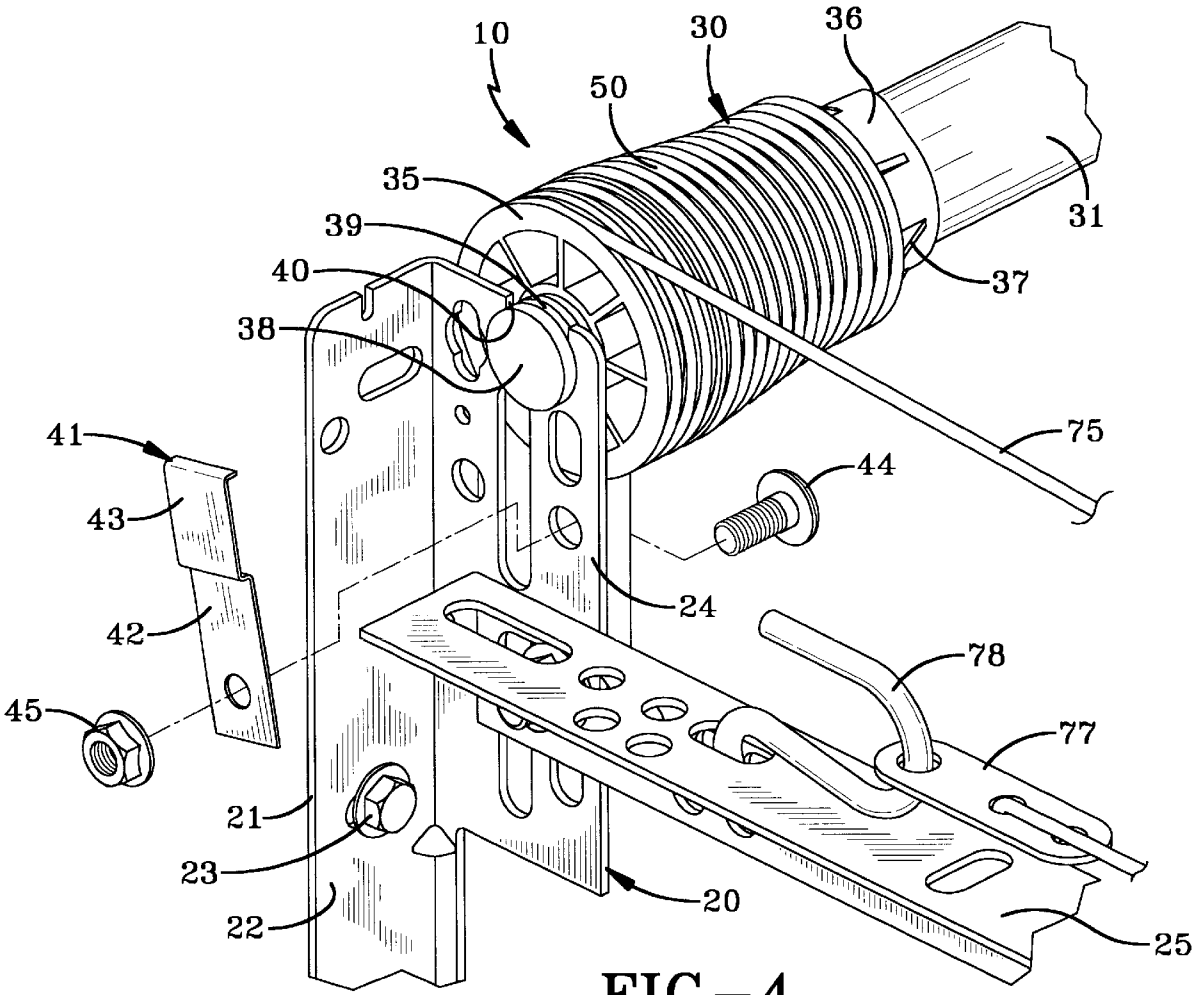
FIG. 4 is an enlarged fragmentary perspective view depicting the cable drum to the left side of the door seen in FIG. 1 showing details of the mounting and retention of the cable drum and drive tube.

The cable drum mechanisms 30 each include a cable drum 35 which is of a generally cylindrical configuration. The cable drum 35 has at its inboard end an axially projecting drum sleeve 36 which receives drive tube 31 and may be provided with a plurality of circumferentially spaced reinforcing ribs 37. As can be seen in FIGS. 2 and 4, the drum sleeve 36 is noncircular in the manner of the drive tube 31 and is sized to telescopically receive drive tube 31, whereby cable drums 35 at all times rotate with the drive tube 31.

As best seen in FIG. 4, the cable drums 35 are positioned for rotation with the drive tube 31 by cylindrical drum supports 38 which have radially indented bearing surfaces 39. The bearing surfaces 39 are sized to fit within notches 40 located in the projecting leg 24 of the flag angles 20. The drum support 38 is maintained seated in the notches 40 by a drum keeper bracket 41 seen in FIG. 4. The drum keeper bracket 41 has an attachment leg 42 and a U-shaped retainer leg 43. The retainer leg 43 overlies the end of drum support 38 and may reside in part in the notch 40 when assembled. The drum keeper bracket 41 is maintained with the retainer leg 43 positioned over drum support 38 by a bolt 44 and nut 45 which secures the attachment leg 42 of drum keeper bracket 41 against the projecting leg 24 of flag angles 20. Thus, the cable drums 35 are supported and retained after assembly in the position depicted in the drawing figures.

Figure 3:
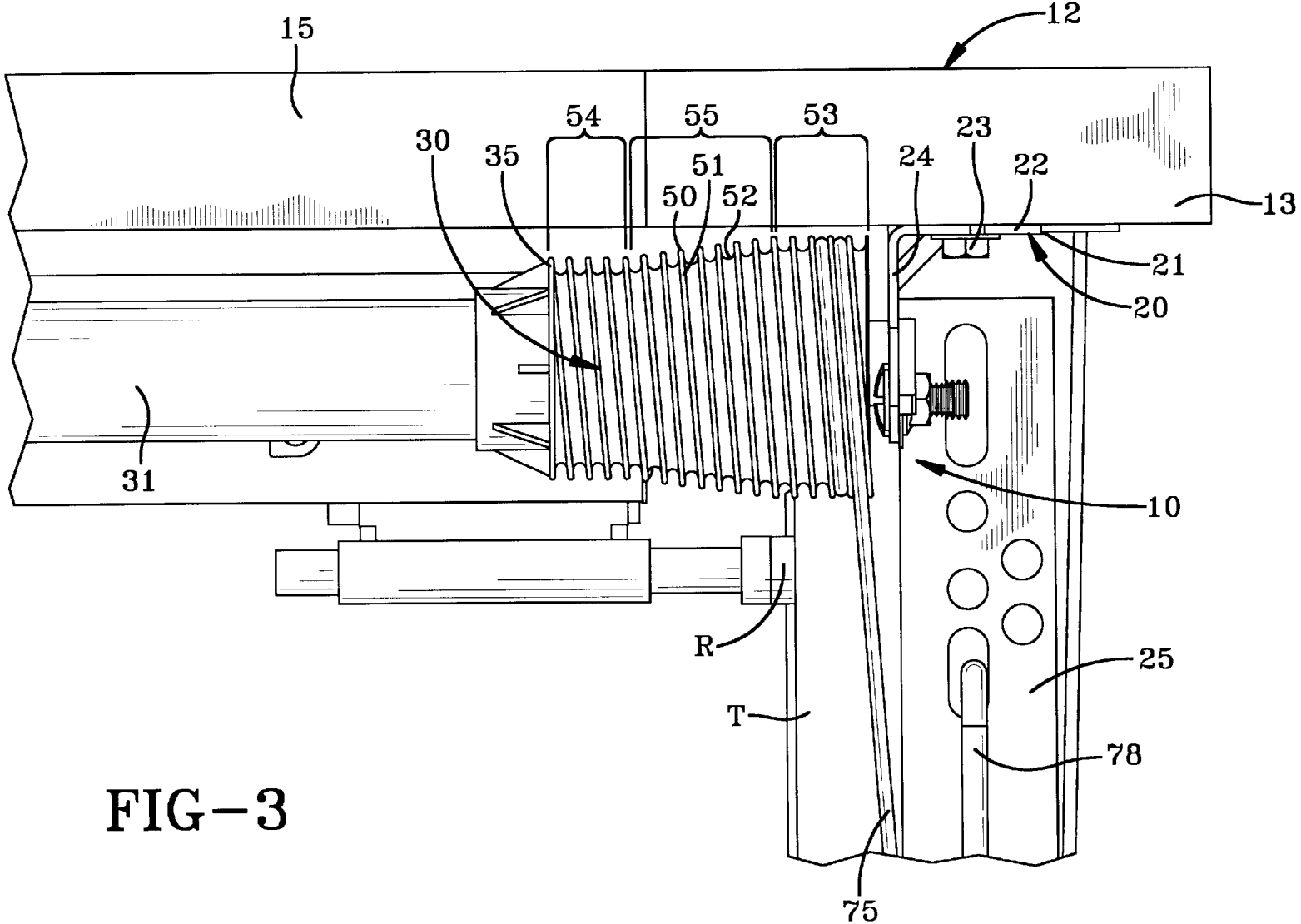
FIG. 3 is a top plan view of the right side of the door seen in FIG. 1 showing the interrelation between the counterbalance cable and the cable drum with the door in the closed vertical position.

As can be seen in FIGS. 2–4 of the drawings, the cable drums 35 have a cylindrical or tapered cylindrical surface 50 over a substantial portion of the axial length thereof. The cable drums 35 have the cylindrical surface 50 thereof provided with continuous helical grooves 51 having a minor diameter 52 located as best seen in FIG. 3 of the drawings. The cylindrical surface 50 has an outboard array 53 of a plurality of helical grooves 51 which may all have substantially the same minor diameter 52. As shown, the cylindrical surface 50 of cable drums 35 also has an inboard array 54 of a plurality of helical grooves 51 having substantially the same minor diameters 52. As can be appreciated from FIG. 3, the helical grooves of the inboard array 54 have a minor diameter which is less than the minor diameter 52 of the helical grooves 51 of the outboard array 53. An intermediate array 55 of the grooves 51 is interposed between the outboard array 53 and the inboard array 54. The minor diameter 52 of helical grooves 51 in the intermediate array 55 is less than the minor diameter 52 of grooves 51 of the outboard array 53 and greater than the minor diameter 52 of helical grooves 51 of the inboard array 54. In the preferred embodiment of the invention depicted in the drawings, the minor diameter 52 of grooves 51 of the intermediate array 55 varies substantially linearly from the minor diameter 52 of helical grooves 51 of outboard array 53 to the minor diameter 52 of helical grooves 51 of the inboard array 54. It is to be appreciated that other variations may be introduced in the profile of the cable drums 35 in instances where the door sections 16–18 may have different weights so that the effective weight of the door varies nonlinearly as the door moves between the closed vertical position and the open horizontal position. Thus, the cable drums 35 are designed so that the diameter 52 of the helical grooves 51 along the axial extent of the cable drums 35 takes into account the weight of the door D in the vertical position being acted upon by gravity as a function of the position of the door D.

The counterbalance system 10 in the preferred embodiment disclosed herein has an extension spring assembly, generally indicated by the numeral 60, associated with each of the cable drum mechanisms 30. Inasmuch as the extension spring assemblies associated with each of the cable drums 35 are identical, only the extension spring assembly 60 seen in FIG. 2 as taken from the right side of FIG. 1 is described in detail. As best seen in FIG. 1, the extension spring assembly 60 is generally aligned between a cable drum 35 and a rear ceiling support 61 which also supports the track T. The extension spring assembly 60 uses a conventional extension spring 62 of the type commonly employed in the industry. Attached to one end of extension spring 62 is an eye bolt 63 which is in turn attached to the rear ceiling support 61 by nut 64 which threads on the eye bolt 63. This secures the extension spring 62 at its rear end to the rear ceiling support 61. The front end of extension spring 62 opposite the eye bolt 64 has a sheave fork 65 permanently attached thereto. The sheave fork 65 mounts a sheave 66 on a pivot axis in the form of a bolt 67.

To prevent possible damage to person or property in the event of failure of the extension spring 62 or components to which it is attached when extension spring 62 is tensioned, a conventional snubber assembly, generally indicated by the numeral 70, is provided. The snubber assembly 70 consists of a snubber cable 71 which is threaded through the extension spring 62 and secured to the rear ceiling support 61 at one end and to the frame 12 at the other end at a position generally aligned with the axis of the extension spring 62. The snubber cable 71 may be attached to the frame 12 by a clip 72 and a lag screw 73 extending through the clip 72 into the frame 12.

The extension spring assembly 60 is interconnected with the door D by a counterbalance cable 75. The counterbalance cable 75 may be of a construction commonly employed in the industry and has one extremity secured to a bottom bracket 76 on the bottom section 17 of the door according to conventional practice. The second end of the cable 75 is secured to a clip 77 which receives an S-hook 78 which may be attached to a horizontal angle iron 25 as best seen in FIG. 2. The counterbalance cable 75 proceeds rearward of the door D from the clip 77 where it is threaded around the sheave 66 attached to the extension spring 62 which redirects the cable toward the door D. In particular, the cable proceeds forwardly from the sheave 66 where it engages the cable drum 35, rather than a conventional sheave, prior to being directed downwardly to its attachment point at the bottom bracket 76 on the door D, as seen in FIGS. 2 and 3.

As can be appreciated from FIGS. 2 and 3, the counterbalance cable 75 extends from the sheave 66 and engages the top of the cable drum 35 where it is looped or reeved one full turn around the cable drum 35 and through an additional, approximately ninety degree, interval before the cable departs tangentially downwardly to where it is anchored to the bottom bracket 76 with the door in the closed position seen in the drawings. In the filly open position of the door D, the counterbalance cable 75 may engage the cable drum 35 through a slightly greater circumferential extent, e.g., on the order of approximately 135 degrees beyond one full turn. It is significant to operation of the door D that the tension supplied by extension spring 62 and the diameter of the helical grooves 51 be related to the effective weight of the door D at any point in moving between the open horizontal position and the closed vertical position so that the counterbalance cable 75 does not slip on the cable drum 35 at any time during the operating cycle of the door D. If necessary to insure adequate friction between the helical grooves 51 of cable drum 35 and counterbalance cable 75 to preclude slippage, the counterbalance cable 75 may be looped a second full turn or more around the cable drum 35 between the entry location of counterbalance cable 75 from sheave 66 and the departure location to the door D.

Once assembled and adjusted with appropriate extension springs 62 and configuration of the cable drums 35, the door D enjoys improved operating parameters. As will be appreciated, the large minor diameter 52 of helical grooves 51 in the outboard array 53 reduces the linear tensioning effect of extension spring 62 to allow the door D to increasingly control door movement during the last 18 to 24 inches from closure so that the door D fully closes and maintains the closed vertical position. The diameter of the helical grooves 51 of inboard array 54 is selected so that in the final 12 to 18 inches of door movement prior to reaching the open horizontal position, the remaining weight of the door operating against the spring 62 is minimized to permit immediate stable positioning of the door D upon reaching the fully open position. The minor diameter 52 of helical grooves 51 in the intermediate array 55, in varying normally substantially linearly between the helical grooves 51 of the outboard and inboard arrays 53, 54, provides a substantially uniform transition area accommodating the linear change in tension of extension spring 62 to provide smooth intermediate movement of the door D. The three arrays 53, 54 and 55 of the helical grooves 51 allow the use of springs having an increased spring tension which assists in moving the door D upwardly out of the opening established by frame 12 and prevents slippage of the counterbalance cable 75 on the helical grooves 51 of the cable drums 35.

Thus, it should be evident that the counterbalance system disclosed herein carries out one or more of the objects of the present invention set forth above and otherwise constitutes an advantageous contribution to the art. As will be apparent to persons skilled in the art, modifications can be made to the preferred embodiment disclosed herein without departing from the spirit of the invention, the scope of the invention herein being limited solely by the scope of the attached claims.

What is claimed is:

1. A counterbalance system operative with an upwardly acting sectional door comprising, a drive tube, a cable drum nonrotatably mounted on said drive tube and having grooves of varying minor diameter, an extension spring mounted in operative relation to said cable drum, and a cable forming a loop about said cable drum and interconnecting said extension spring and the door, said loop moving axially of said cable drum in said grooves, whereby said extension spring and said cable drum combine to provide selective counterbalance forces to the door during its range of movement.

2. A counterbalance system according to claim 1, wherein said grooves on said cable drum are helical.

3. A counterbalance system according to claim 2, wherein said cable drum has an outboard array of said grooves having a first diameter and an inboard array of said grooves having a second diameter.

4. A counterbalance system according to claim 3, wherein said first diameter is larger than said second diameter.

5. A counterbalance system according to claim 4, wherein an intermediate array of said grooves is positioned between said outboard array of said grooves and said inboard array of said grooves.

6. A counterbalance system according to claim 5, wherein said grooves of said intermediate array of grooves have differing diameters.

7. A counterbalance system according to claim 6, wherein said differing diameters of said intermediate array of grooves vary substantially linearly from said first diameter to said second diameter.

8. A counterbalance system according to claim 1, wherein said cable is looped about said cable drum substantially one time.

9. A counterbalance system according to claim 1, wherein said cable is looped about said cable drum multiple times.

10. A counterbalance system according to claim 1, wherein said cable is looped about said cable drum substantially two times.

11. An upwardly acting sectional door system comprising, a door having a plurality of hinged door sections movable between a closed vertical position and an open horizontal position, a drive tube mounted above said door in said closed vertical position, cable drums having grooves of varying diameter mounted on said drive tube for rotation therewith, extension springs mounted in operative relation to said cable drums, and counterbalance cables forming loops about said cable drums and interconnecting said springs and said door to counterbalance said door when moving between said closed vertical position and said open horizontal position, wherein said counterbalance cables have one end attached to one of said door sections, have the other end fixedly secured, and have an intermediate portion with said loop engaging and moving axially of one of said cable drums and operatively interrelated with one of said springs during movement of said door.

12. A sectional door system according to claim 11, wherein said counterbalance cables are looped about said cable drums through approximately one and one-quarter turns.

13. A sectional door system according to claim 11, wherein said counterbalance cables are looped about said cable drums through a plurality of turns.

14. A sectional door system according to claim 11, further comprising, a door frame, flag angles connected to said doorframe, drum supports freely rotatably mounting said cable drums on said flag angles, and drum keeper brackets retaining said drum supports positioned on said flag angles.

15. A counterbalance system for an upwardly acting sectional door comprising, a drive tube, a cable drum having grooves of varying diameter mounted on said drive tube for rotation therewith, an extension spring mounted adjacent to the door and having a movable end thereof, and a cable looped about said cable drum and operatively interconnecting said movable end of said extension spring and the door to counterbalance the door during its range of movement, whereby the counterbalance forces provided to the door by said extension spring are adjusted by said cable drum as a function of the position of the door.

16. A counterbalance system according to claim 15, wherein a sheave assembly is attached to said movable end of said extension spring and receives said cable.

17. A counterbalance system according to claim 16 further comprising, a fixed support to which one end of said cable is secured.

18. A counterbalance system according to claim 17, wherein a clip and a hook secure said one end of said cable to said fixed support.

19. A counterbalance system according to claim 17, wherein the other end of said cable is secured to the door.

20. A counterbalance system according to claim 19, wherein said cable extends from said door, around said cable drum, around said sheave assembly and to said fixed support.

21. A counterbalance system according to claim 18, wherein said clip and said hook are disposed substantially between said sheave and said cable drum.

22. A counterbalance system according to claim 15, said cable is looped at least one full turn about said cable drum, whereby said cable engages said grooves in said cable drum without relative slippage therebetween during movement of the door.

23. A counterbalance system according to claim 22, wherein said one full turn of said cable moves axially along said cable drum in said grooves attendant rotation of said cable drum.

24. A counterbalance system for an upwardly acting sectional door comprising, a rotatable drive tube, a cable drum mounted on said drive tube for rotation therewith, an extension spring mounted adjacent to the door, a cable looped about said cable drum and operatively interconnecting said extension spring and the door to provide counterbalance forces to the door during its range of movement, and means for varying the counterbalance forces provided by said extension spring to the door as a function of the position of the door.

25. A counterbalance system according to claim 24, wherein said means for varying the counterbalance forces includes grooves on said cable drum of differing diameters.

* * * * *